US005781166A

United States Patent [19]

De Zwart et al.

[11] Patent Number: 5,781,166

[45] Date of Patent: Jul. 14, 1998

[54] FLAT PANEL DISPLAY HAVING ELECTRON TRANSPORT DUCTS WITH EQUAL PROPAGATION PATHS FROM ENTRANCE TO EXIT

[75] Inventors: Siebe T. De Zwart, Valkenswaard; Nicolaas Lambert, Waalre; Gerardus G.P. Van Gorkom, Geldrop; Petrus H.F. Trompenaars, Tilburg, all of Netherlands

[73] Assignee: U.S. Philips Corporation, New York, N.Y.

[21] Appl. No.: 557,074

[22] Filed: Dec. 5, 1995

[30] Foreign Application Priority Data

Apr. 8, 1994 [EP] European Pat. Off. ..... 94201136

[51] Int. Cl.[6] ..... G09G 3/30; G09G 1/04; H01J 29/70

[52] U.S. Cl. ..... 345/76; 313/421; 315/366

[58] Field of Search ..... 345/74, 75, 76; 313/421, 422, 426, 427, 495; 315/167, 169.1, 169.3, 366

[56] References Cited

U.S. PATENT DOCUMENTS

| | | | |
|---|---|---|---|
| 4,115,724 | 9/1978 | Endriz | 315/366 |
| 4,118,651 | 10/1978 | Scott | 313/422 |
| 4,181,871 | 1/1980 | Gange | 313/422 |
| 4,215,293 | 7/1980 | Stanley | 315/366 |
| 4,335,332 | 6/1982 | Gredelle | 315/366 |
| 4,514,663 | 4/1985 | Vieland | 315/366 |
| 5,126,628 | 6/1992 | Kishimoto et al. | 313/422 |
| 5,270,611 | 12/1993 | Van Gorkom | 313/422 |
| 5,313,136 | 5/1994 | Van Gorkom | 313/422 |
| 5,347,199 | 9/1994 | Van Gorkom | 315/169.1 |

FOREIGN PATENT DOCUMENTS

| | | | |
|---|---|---|---|
| 0436997 A1 | 7/1991 | European Pat. Off. | H01J 31/12 |

*Primary Examiner*—Steven J. Saras
*Assistant Examiner*—Paul A. Bell
*Attorney, Agent, or Firm*—Robert J. Kraus

[57] ABSTRACT

A display device including a vacuum envelope having an electroluminescent screen, an electron source and a branched network of electron-transport ducts having at least one entrance for electrons and at least two exits at end portions of the network. An electron current flows from the entrance to a desired one of the exits via nodes in the network. The network exits corresponding to one entrance form a two or three dimensional array of exits. Preferably, the distance, via the network, between an entrance and its corresponding exits is equal.

22 Claims, 10 Drawing Sheets

FLAT PANEL DISPLAY HAVING ELECTRON TRANSPORT DUCTS WITH EQUAL PROPAGATION PATHS FROM ENTRANCE TO EXIT

BACKGROUND OF THE INVENTION

This invention relates to a display device comprising a vacuum envelope an inner side of which is provided with an electroluminescent display screen, said vacuum envelope comprising at least an electron source and means for directing electrons towards the display screen, said means comprising electron ducts.

Such a display device is known from European Patent Application EP 0 436 997. Electron transport between the electron source (for example a wire cathode) and the cathodoluminescent screen takes place by means of electron-transport ducts. In electron-transport ducts, electrons are transported from an entrance to an exit by applying a voltage across the transport duct. If an electron current is injected into the transport duct via the entrance, interactions between the electrons and the wall cause an electron current in the transport duct. A simplified, explanatory description of this phenomenon is that electrons impinging on the wall generate secondary electrons. Due to the applied voltage, said secondary electrons are transported in the transport duct and also impinge on the wall of the electron-transport duct and generate secondary, "secondary" electrons. An electron current is thus formed in the direction of propagation of the electron-transport duct.

The resolution of a picture displayed on a display screen is governed, inter alia, by the number of pixels per unit area. The aim is to increase the resolution of the picture displayed. In general, the complexity and the number of pixels of the display device increase as the resolution of the picture displayed increases. A further aim is to increase the picture size of the display device as much as possible. This, too, leads to a greater complexity and an increase of the number of pixels of the display device. The greater the complexity of the display device, the higher the cost price and the number of rejects (the percentage of display devices produced which have defects which are so serious that the quality requirements are not met).

SUMMARY OF THE INVENTION

It is an object of the invention to provide a display device of the type mentioned in the opening paragraph, the construction of which has been simplified and/or the number of rejects reduced.

To this end, the display device is characterized in that the means for directing electrons towards the display screen comprise a branched network of electron-transport ducts having at least one entrance for electrons and exits at the end portions of the network, said network having means for directing the electron current entering via the entrance through the branched network, via nodes of the network, towards a desired exit.

In display devices, a picture is generally composed of lines. This becomes manifest in the way in which a picture is picked up, processed and imaged, and in the construction of the known display devices. Display devices exhibit a "horizontal" or "vertical" structure. Electron currents move in "vertical" or "horizontal" directions or are deflected in said directions. Within the scope of the invention, this construction has been abandoned, as far as the transport of electrons is concerned, and replaced by a, preferably, two or three-dimensionally branched network structure. A node in the network is a part of the network where at least three transport ducts meet. This enables the construction of the display device to be simplified. In addition, a simple, modular construction of the display device becomes possible.

Preferably the network is two- or three dimensional branched and the exits form a two- or three dimensional array.

Preferably, the distance, via the network, between an entrance and each exit which can be reached from said entrance, via the network, is substantially equal.

The propagation properties of a transport duct are also governed by the length of the transport duct. If the distances between an entrance and the exits which can be reached from said entrance are substantially equal, the differences in propagation properties, if any, are few. By virtue thereof, inhomogeneities in the brightness of the picture displayed are reduced.

Between an entrance and an exit there is preferably no second exit.

Thus, undesired loss of electrons through an exit is impossible. Undesired loss of electrons adversely affects the homogeneity of the picture displayed.

Preferably, the number of nodes situated between an entrance and an exit is the same for each entrance and exit.

By virtue thereof, inhomogeneities in the brightness of the picture displayed are reduced.

The number of nodes between an entrance and an exit, preferably, does not exceed 12.

This has a positive effect on the inhomogeneities in the picture displayed.

Preferably, the number of nodes between an entrance and an exit is greater than 4.

The number of exits of the network is preferably $n^m$, wherein n and m are integers greater than 1. Such a number of exits enables a simple construction of the network to be achieved.

The means are preferably constructed so that, viewed from an entrance, there are at least two different paths along which an ingoing electron current can be directed through the network towards an exit.

This has the advantage that there is an alternative route through the network if the customary path for the electrons from the or an entrance to the or an exit is obstructed or cannot be used. By virtue thereof, the number of rejects can be reduced.

In an embodiment, the means are provided with ducts which are situated around one or more nodes of the network, and which can be activated selectively.

A second aspect of the invention consists in a means for directing electrons, said means comprising a branched, preferably two or three-dimensionally branched, network of electron-transport ducts having one or more entrances for injecting electrons into the network and one or more exits for extracting electrons from the network, said network comprising means for directing the electron current entering via an entrance through nodes of the branched network towards a desired exit.

Such a means can be used in a display device in which, for example, electron currents are directed from an entrance of the network towards exits, as described hereinabove. Said means can alternatively be used in a pick-up device or photometer, in which case said means has a large number of entrances in front of which photosensitive elements are arranged which emit electrons under the influence of light.

Said electrons are subsequently selectively directed towards an exit via the network. By virtue thereof, the light distribution over a surface can be measured.

The invention also relates to a display device comprising a vacuum envelope on an inner side of which there is provided an electroluminescent display screen, said vacuum envelope comprising at least an electron source and means for directing electrons towards the display screen, said means comprising electron ducts, characterized in that the means comprise at least one transport duct having a single entrance aperture at one side of the transport duct and, at the opposite side two or more exhaust apertures. Very fast switching can then be accomplished.

Furthermore the invention also relates to a display device comprising a vacuum envelope on an inner side of which there is provided an electroluminescent display screen, said display device comprising means for selectively directing electron currents from at least one source to the display screen, said means comprising electron ducts, characterized in that the means comprise two or more partially overlapping networks of transport ducts, each having one starting duct and sharing common transport ducts ending in at least partially common end ducts. By using overlapping networks, sharing common transport ducts, redundancy is built into the device. Malfunctioning of a source can thereby be overcome.

BRIEF DESCRIPTION OF THE DRAWINGS

These and further aspects of the invention will be described in greater detail, by way of example, and with reference to the accompanying drawings, in which.

The drawings are schematic and generally not drawn to scale, and like reference numerals generally refer to like parts.

DETAILED DESCRIPTION OF THE PREFERRED EMBODIMENTS

Figure 1:
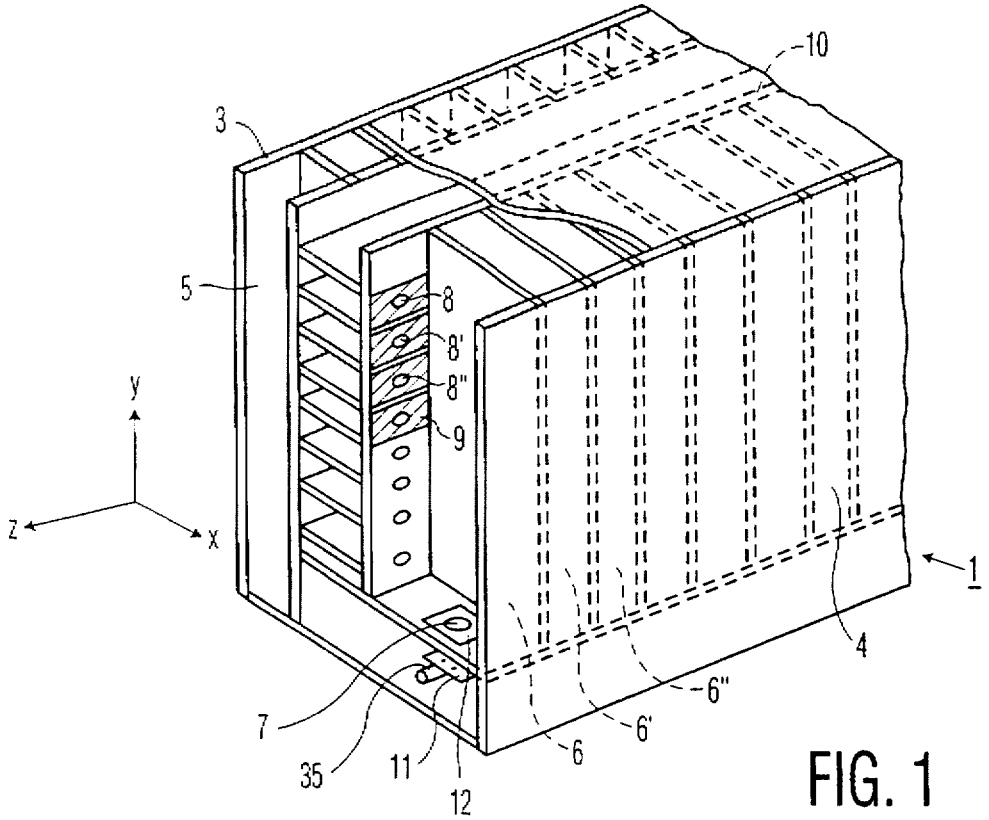
FIG. 1 PRIOR ART
FIG. 1 shows a display device in accordance with the present state of the art.

FIG. 1 show a display device in a partly perspective view and in a sectional view respectively. Display device 1 has a transparent front wall (window) 3 and a rear wall 4 which is located opposite said front wall. An electroluminescent screen 5 is provided on said window. Transport ducts 6, 6', 6" for transporting electrons extend parallel to the rear wall, for example, in the y-direction. The electrons are transported through a transport duct by applying a potential difference across the transport duct. Each transport duct comprises an entrance aperture 7 and a number of exit apertures 8, 8', 8". The display device further comprises means for extracting electrons from the transport ducts via the exit apertures 8. In this example, said means are formed by electrodes 9 on walls 10 around the apertures 8. A potential difference is applied between the electrodes 9 and the luminescent screen 5, as a result of which the electrons migrate to the display screen 5 and impinge on the luminescent material which, as a result, emits light.

The display device comprises a means for injecting electrons into the transport ducts 6. In this example, said means comprises a line cathode 35 and a system of electrodes $G_1$, (11) and $G_2$ (12). $G_1$ is a control electrode which, in this example, is driven separately for each duct. $G_2$ is an electrode which is common to a number of transport ducts 6. The line cathode 35 and the $G_1$ and $G_2$ electrodes jointly constitute a triode. By heating the line cathode 35 and applying a potential difference between the line cathode 5 and the electrode $G_2$, electrons are directed towards the entrance apertures in the transport ducts. The potential on the control electrodes $G_1$ determines the intensity of the electron current entering the transport ducts. An array of 16 ducts, in which each of the ducts 16 comprises apertures 8, requires 16 $G_1$-control electrodes and 16 electrodes for extracting electrons from the transport ducts at the location of the apertures. Each $G_1$-electrode requires a control voltage for controlling the number of electrons injected into the transport ducts 6. In operation, a transport voltage is applied across a transport duct. This results in the formation of an electric field in the transport duct. If an electron current is injected into the transport duct via an entrance aperture 7, the electric field and interactions between the electrons and the wall cause an electron current in the transport duct of the entrance aperture 7 which moves in the direction of the exit aperture 8, 8', 8". A simplified explanatory description of this phenomenon is that electrons collide with the wall and generate secondary electrons. The electric field causes the secondary electrons to be transported in the longitudinal direction of the electric field in the transport duct, said secondary electrons also impinge on the wall of the electron-transport duct and generate secondary "secondary" electrons. Thus, an electron current is formed in the direction of propagation of the electron-transport duct. A number of electrodes 9 are shown in FIG. 1. The voltage applied to the electrodes is higher as an electrode is farther removed from the entrance aperture. Due thereto, an electric field is generated in the transport duct. Apart from being propagated in the transport duct, the electron currents must also be extracted from the transport ducts via the exit apertures 8, 8', 8". This is achieved by temporarily applying a voltage to one of the electrodes 9, which is several hundred volts higher than the voltage applied to the surrounding electrodes. By virtue thereof, the electrons are extracted from the transport duct in the direction of the display screen 5.

As is clearly shown in the Figure, the transport ducts extend in one direction, in this case the vertical (y-)direction. The electron currents in the transport ducts also extend in the vertical direction. If the electron currents are projected on a plane parallel to the display screen, the manner in which the currents are distributed is one-dimensional. The known display devices therefore exhibit a "horizontal" or "vertical" structure. Electron currents move in "vertical" or "horizontal" directions or are deflected in these directions. Within of the scope of an embodiment of the invention, this construction has been abandoned as regards the transport of electrons and has been replaced by a two or three-dimensionally branched network structure. This enables a simplification of the display device to be achieved.

Figure 2:
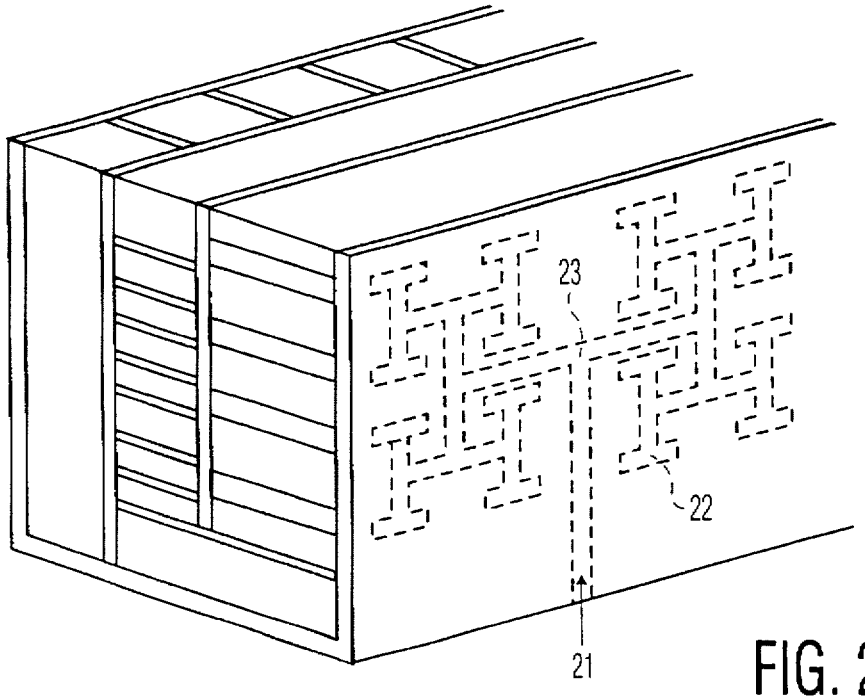
FIG. 2 shows a display device in accordance with the invention.

FIG. 2 shows a display device in accordance with the invention.

Figure 3B:
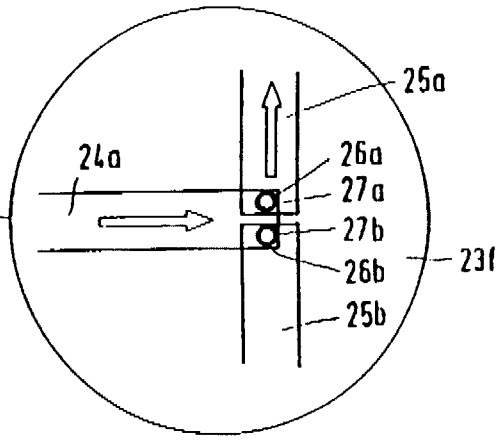
FIGS. 3A and 3B are schematic top views of a means for directing electron currents in accordance with the invention.
Figure 3A:
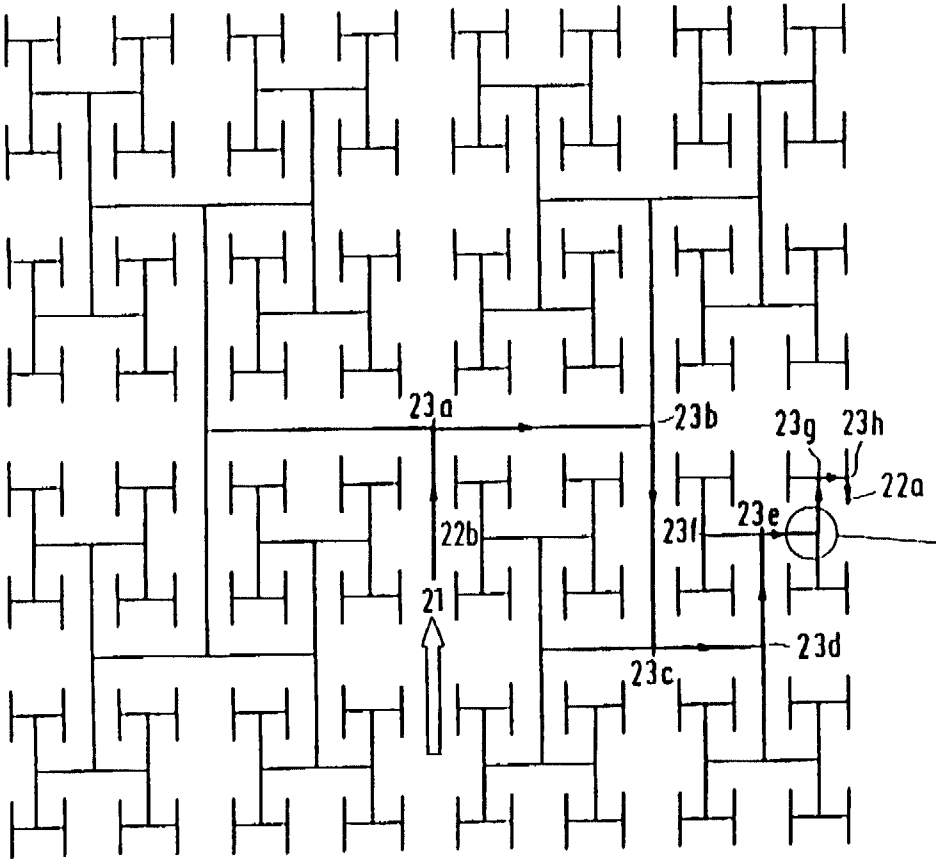

The display device comprises a system of transport ducts 21 which branches at a point 23. An electron current which is introduced into the network at point 21 is subsequently directed towards the exits 22 via a large number of electron junctions 23 (hereinafter also referred to as "current junctions"). At each of said electron junctions, the electron current is led, in this example, in one of two directions. The current junctions can be regarded as the nodes of the network. In this example, the exits form a two or three-dimensional array and the nodes of the network also form a two or three-dimensional array. If the projection of the electron currents on a plane parallel to the display screen is considered, then the electron current distribution is two-dimensional. FIG. 3A is a top view of such a branched network. The electron current travels from the entrance 21 to exits 22, for example exit 22*a*, via eight current junctions 23*a* to 23*h*. The exits 22 form a two-dimensional array, as do the current junctions. FIG. 3B is a more detailed view of a current junction (in this example 23*f*). Each current junction or node in the network comprises, in this example, an electron-supply duct 24*a* and two electron-exhaust ducts 25*a* and 25*b*, apertures 26*a* and 26*b* forming the connections between the supply and exhaust ducts and control electrodes 27*a* and 27*b* which can be energized so as to selectively guide the electrons into one of the two exhaust ducts 25*a* or 25*b* via the connecting apertures 26*a* or 26*b*, respectively. Viewed from the entrance 21, the bias on the electrodes increases in the direction of the exits 22. For example, the voltage on the electrodes in front of the current junction 23*a* is several tens to several hundred volts higher than the voltage in front of the entrance 21, the voltage on the electrodes in front of the current junction 23*b* is several tens to several hundred volts higher than the voltage on the electrodes in front of current junction 23*a*, etc., etc. This results in an electric field being applied across the transport ducts between the current junctions, said field ensuring that electrons entering via the entrance travel through the network. The electron current is controlled by applying a voltage higher than the normal bias voltage to one of the electrodes, a voltage lower than the bias voltage preferably being applied to the other electrode. As a result, the electrons are led into the exhaust duct associated with said one electrode. Calculating from the entrance 21, a number can be assigned to a node or current junction 23 in the network, which corresponds to the number of current junctions between the relevant current junction and the entrance plus one. This number is hereinafter also referred to as the order of the current junction or, alternatively, a current junction is referred to as "current junction of the $n^{th}$ order". In FIG. 3A, the current junction 23*a* is a current junction of the first order, current junction 23*b* is a current junction of the second order, current junction 23*f* is a current junction of the sixth order. Preferably, electrodes of current junctions of equal order are interconnected. By virtue thereof, the number of electrical connections is reduced. In this example, electrodes associated with current junctions of equal order are interconnected. The electrodes of current junction 23*f* are, for example, connected to electrodes of current junction 23*f'*. In FIG. 3A, the path along which a current entering via entrance 21 is guided to exit 22*a* via the network is represented by a thick line. The overall number of exits is formed by an array of 16×16=256 pixels. One control electrode is required to control the intensity of the electron current which is injected into the network via the entrance 21, and sixteen electrodes are required to drive this array. The total number of control electrodes is 17. The same array of pixels in the known display device comprises 32 control electrodes (i.e. 16+16). For an array of $2^n$ pixels, the known display device needs n+m control electrodes, wherein $n*m=2^n$, i.e. it is minimally $2*2^{n/2}$, whereas the display device as shown in FIGS. 2 and 3 comprises (2n+1) control electrodes. Consequently, the number of control electrodes is reduced. By virtue thereof, the display device can be simplified. FIGS. 2 and 3 show a preferred embodiment in which the distance from the entrance aperture to the corresponding exit aperture, through the network, is substantially the same for each of the exit apertures. This is not true for the display device in accordance with the state of the art. As a result of the vertical structure of the transport ducts, the distance between entrance and exit apertures depends on the position of the exit aperture. Electron current losses may occur in a transport duct. Unless compensating measures are taken, these losses manifest themselves in the known display device as an inhomogeneity in the brightness of the picture displayed. The brightness decreases as the distance between the entrance aperture and the exit aperture increases. In the preferred embodiment of the display device, this phenomenon does not occur, or to a much smaller degree, because, viewed through the network, every exit aperture is situated at a substantially identical distance from the entrance aperture. The network is preferably arranged so that there is no other exit between an entrance and an exit. In the display device in accordance with FIG. 1, there are, viewed along the transport duct, other exits (8', 8") in front of exit 8. As a result, undesirable loss of electrons through an exit 8', 8" is possible. Said undesirable loss of electrons adversely affects the homogeneity of the picture displayed. The network shown in FIG. 3A is constructed so that, viewed along the transport ducts, there is no other exit 22 in front of exit 22. The distance between the entrance 21 and the exit 22*a*, via the network, is approximately equal to the distance, via the network, between entrance 21 and exit 22*b*. Between the entrance and each of the exits there is an equal number of current junctions, namely 8 (current junctions 23*a* to 23*h*). An equal number of current junctions between the entrance and the exits has a positive effect on the homogeneity of the picture displayed. In general, every current junction may lead to a small electron current loss. A small part of the electron current in the supply duct 24 can be captured by electrodes 27. As a result, the electron current in the exhaust duct is smaller than that in the supply duct. If there is an equal number of electrodes between the entrance and each exit, then the loss for each of the exits is equal in a first order approximation, which has a positive effect on the homogeneity of the picture displayed.

Preferably, the number of current junctions (or nodes in the network) between an entrance and an exit of the network does not exceed 12. Small variations occur in the current junctions, which lead to a spread in electron current loss between the entrance and an exit. This leads to intensity differences in the picture displayed, also referred to as "patchiness". This phenomenon is more clearly visible as the number of current junctions between the entrance and the exit is larger, or the manufacturing process must be improved to limit this phenomenon to an acceptable level. Preferably, the number of current junctions is greater than 4. In the case of 4 current junctions, 9 electrodes are required for 16 ($=2^4$) pixels. Table 1 shows for a number of $2^n$ pixels (column 1) the number of control electrodes in the known display device (column 2), the number of control electrodes in the display device in accordance with the invention (column 3) and the quotient of these numbers (column 4). The required number of control electrodes decreases if n>4. The advantage is relatively greatest for an odd number of nodes.

TABLE 1

| pixels | electrodes in state of the art display device | electrodes in display device in accordance with the invention | quotient |
|---|---|---|---|
| 2 | 3 | 3 | 1 |
| 4 | 4 | 5 | 1.2 |
| 8 | 6 | 7 | 1.14 |
| 16 | 8 | 9 | 1.125 |
| 32 | 12 | 11 | 0.92 |
| 64 | 16 | 13 | 0.813 |
| 128 | 24 | 15 | 0.625 |
| 256 | 32 | 17 | 0.531 |
| 512 | 48 | 19 | 0.395 |
| 1024 | 64 | 21 | 0.328 |
| 2056 | 96 | 23 | 0.240 |
| 4112 | 128 | 25 | 0.195 |

The network is simple if the number of exits is equal to $n^m$, wherein n is an integer greater than 1 and m is an integer greater than 1. A network can then be used having m nodes between the entrance and every exit, each node comprising a supply duct and n exhaust ducts. In the examples n is chosen to be two, but obviously, nodes having more than two exhaust ducts fall within the scope of the invention. Two exhaust ducts per node has the advantage that the network can be driven by means of binary codes (a binary code can be assigned to each pixel) and that the nodes are simple too.

The display device is preferably constructed so that it comprises means which make it possible that, viewed from an entrance, there are at least two different paths along which an electron current is directed through the network towards an exit.

This has the advantage that there is an alternative route through the network if the customary path for the electrons from the or an entrance to the or an exit is obstructed or unusable, i.e. a part of the picture is not imaged. By virtue thereof, the number of rejects can be reduced.

Figure 4:
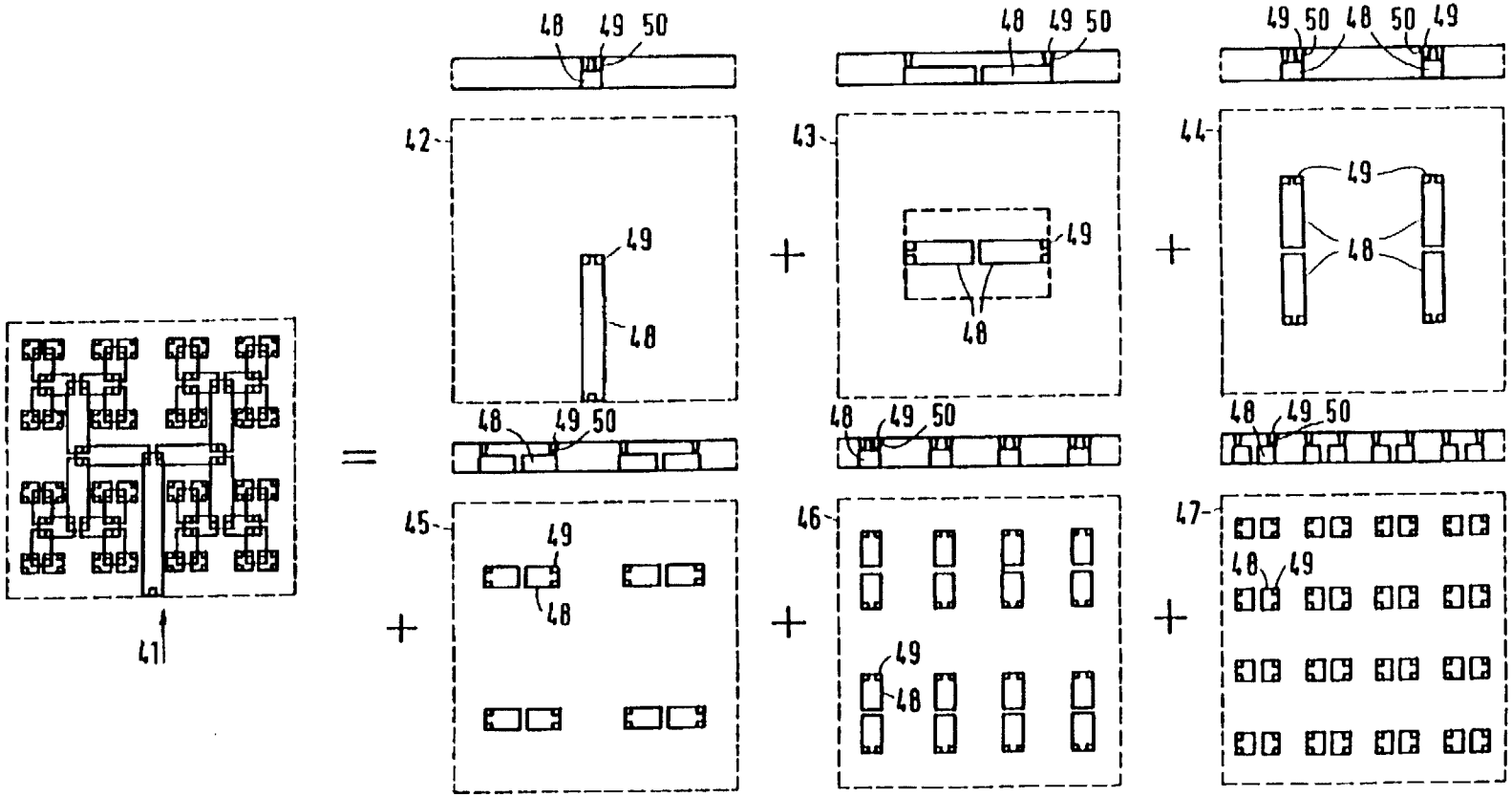
FIGS. 4 and 5 show two embodiments of a means for directing electrons from an entrance towards exits.
Figure 5:
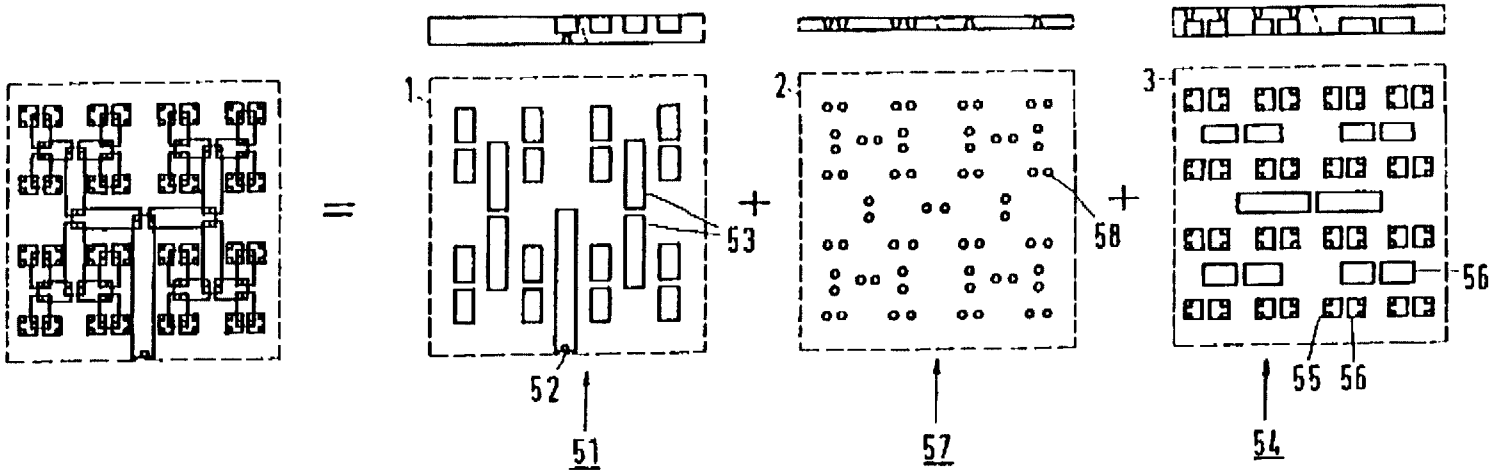
Figure 6:
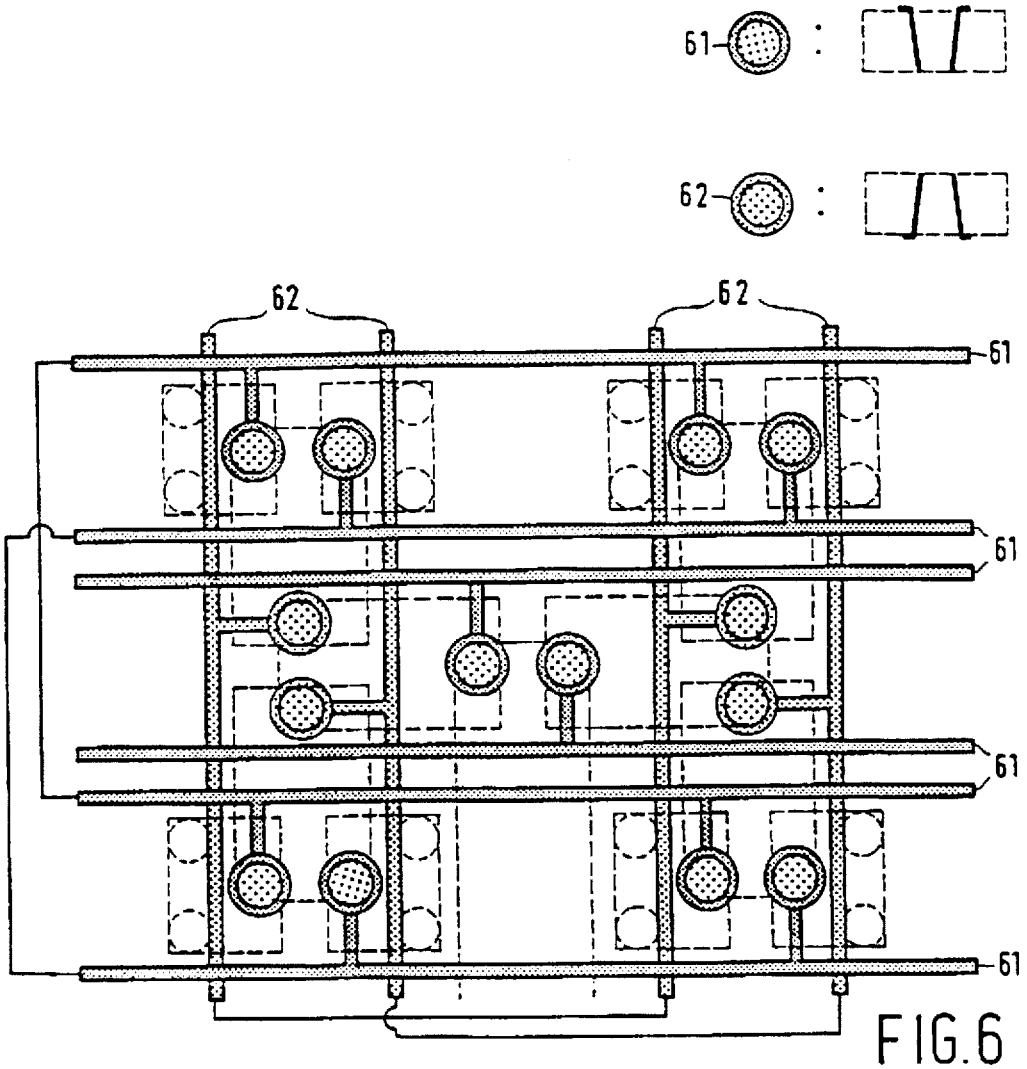
FIG. 6 shows a detail of a means as shown in FIG. 5.

A particular property of the structure shown in FIG. 3 relates to the manner in which a display device can be constructed. Two examples are shown in FIGS. 4 and 5. FIG. 4 shows a construction in which one plate is used for current junctions of the same order. The network 41, a top view of which is shown left most in the Figure, is composed of six plates 42 to 47 which are stacked one on top of the other. A top view and a sectional view, one above the other, of each of said plates is shown. Use is made of bilaterally structured plates, on one side ducts 48 and on the other side apertures 49. The apertures 49 are metallized so as to form electrodes 50. These electrodes 50 are interconnected and, in operation, connected to means for applying a control voltage. Interrupted lines on plate 43 indicate which electrodes are interconnected. The connections are always situated on the upper side of the plates and can be interconnected at the edge. FIG. 5 shows an embodiment in which a much smaller quantity of plates, namely 3, are required, independent of the number of current junctions. Plate 51 comprises the "entrance" 52 and all vertical transport ducts 53; plate 54 comprises all "exits" 55 and all horizontal transport ducts 56. The exits are metallized; the connections are situated on the upper side of the plate 54. Plate 57 is situated between plate 51 and plate 54 and comprises apertures 58 which interconnect the transport ducts in the plates 51 and 54. The apertures 58 in the plate 57 are metallized. The connections are situated on the lower and upper sides of plate 57. FIG. 6 shows the connections, the black lines 61 representing the electrodes on the upper side of plate 57 and the hatching lines 62 representing the electrodes on the lower side of plate 57. The inset shows, in section, apertures having control electrodes 61 and 62. The electrons travel alternately on the upper side and the lower side of the plate 57, through transport ducts in plate 51 and 54. All electrodes associated with current junctions of equal order are interconnected two and two on plate 57. By virtue thereof, the number of electrical supply ducts required is substantially reduced. Electrodes around apertures at the same level are at the same DC bias voltage, which is always much higher than that of apertures at the preceding level. As one and the same plate 57 comprises apertures associated with current junctions of different order (unlike the embodiment shown in FIG. 4, in which plates 42 to 47 each comprise apertures associated with current junctions of one order) a simplification in the construction of the display device can be achieved, as compared to an embodiment as shown in FIG. 4. Fewer plates, in this example 3, are required. Besides, the "depth" of the display device is reduced.

Figure 7:
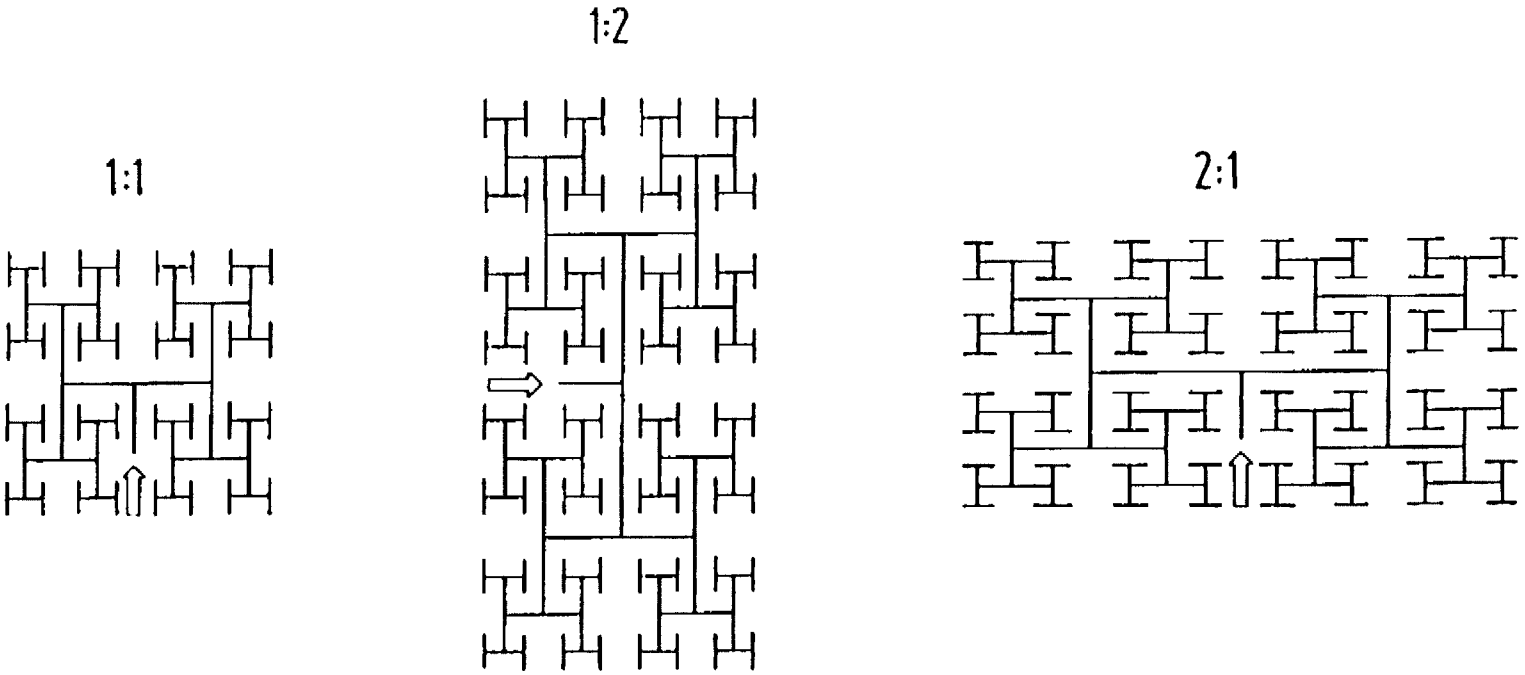
FIG. 7 schematically shows a number of possible two-dimensional networks.

The two-dimensional structure shown is suitable for a modular lay-out of the display device. The display device can then be subdivided into "tiles". FIG. 7 shows a number of possible length-width ratios of such "tiles". The arrows indicate the entrance for the electrons.

Figure 8:
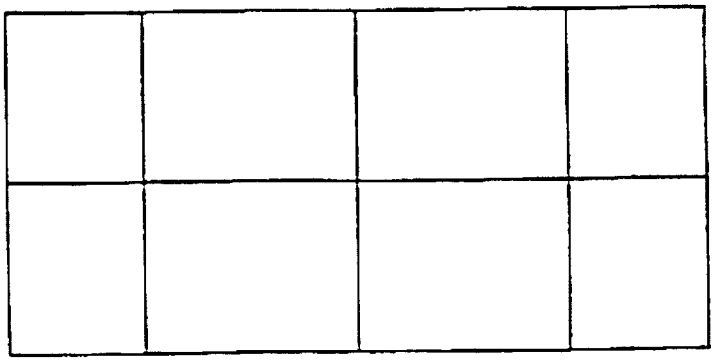
FIG. 8 is a front view of a display device.

The advantage of such a modular construction is that the interconnection of electrodes permits fewer control voltages to be used. A further advantage resides in that one and the same display device can be made suitable for the reception of television images having an aspect ratio of 3:4 and 9:16. FIG. 8 shows a "tile distribution" enabling this. The central portion is composed of four tiles which jointly constitute a display device having an aspect ratio of 3:4. On either side of said central portion there are two "tiles". All eight "tiles" jointly constitute a display device having an aspect ratio of 9:16.

Figure 9:
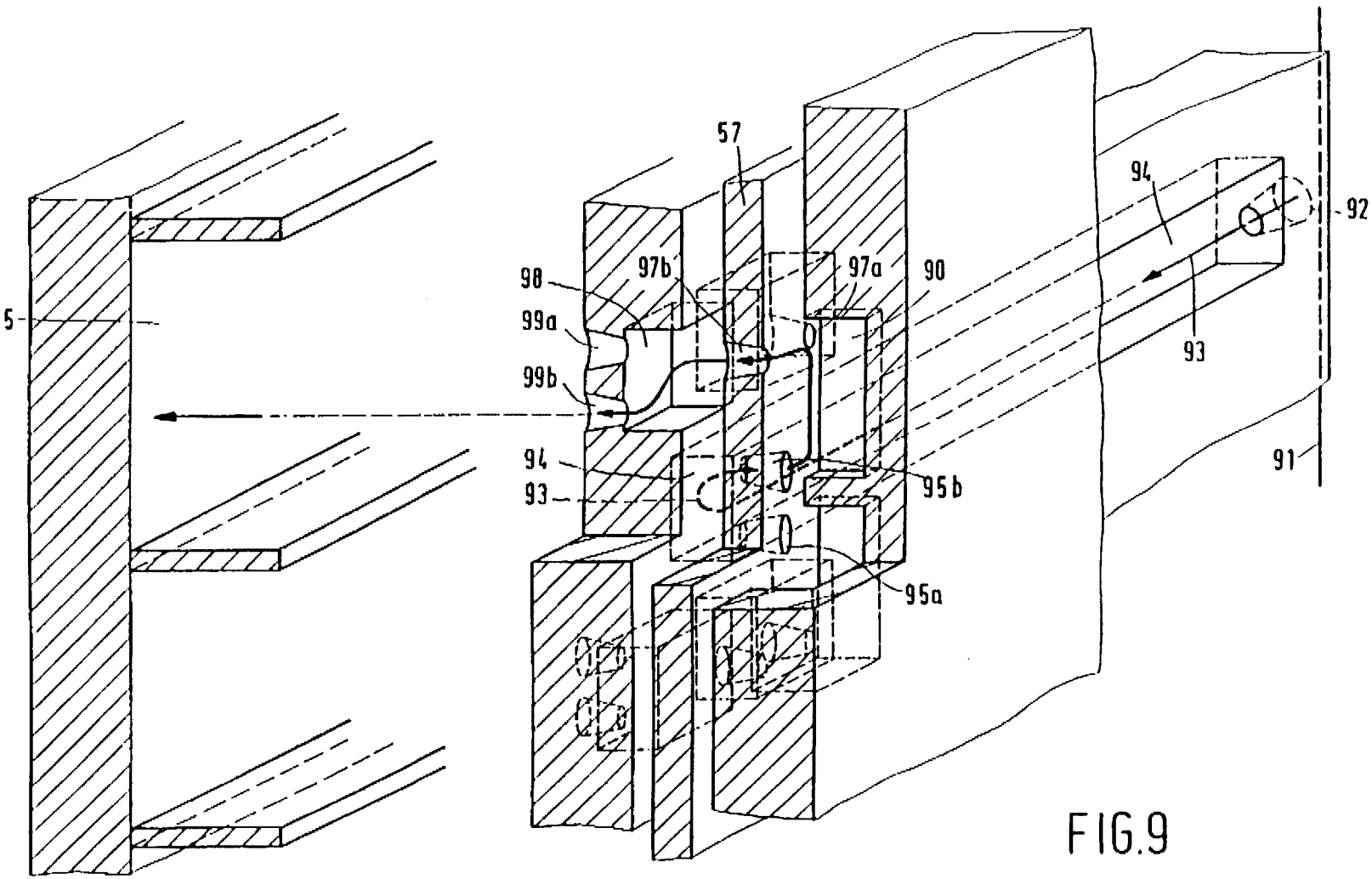
FIG. 9 shows the electron currents in a display device.

FIG. 9 show some details of an embodiment of a display device in accordance with the invention. FIG. 9A shows line cathode 91 and entrance 92 of transport duct 94. The electron current 93 through the transport duct 94 is indicated by a thick line. The transport duct 94 is provided at one end with two apertures 95*a* and 95*b* in plate 57. These apertures are surrounded by electrodes (not shown in this Figure). The electron current is injected into the transport duct 90 through one of these apertures, in this example aperture 95*b*. This transport duct is provided at one end with two apertures 97*a* and 97*b* in plate 57. The electron current is injected into the transport duct 98 through aperture 97*b*. This transport duct comprises apertures 99*a* and 99*b*. In this example, the electron current is injected through aperture 99*b* and then accelerated towards the display screen 5.

The display device is preferably constructed so that it comprises means which make it possible that, viewed from an entrance, there are at least two different paths along which an ingoing electron current can be directed through the network towards an exit.

This has the advantage that, in case the customary path for the electrons of the or an entrance to the or an exit is obstructed or cannot be used, i.e. a part of the picture is not imaged, there is an alternative route through the network. By virtue thereof, the number of rejects can be reduced.

In the foregoing embodiments, the network is two-dimensional, the exits form a two-dimensional array and the nodes of the network also form a two-dimensional array. The term two-dimensional is to be understood to mean herein that, viewed in projection on the display screen, the current distribution is two-dimensional. A device according to the above shown embodiments of the invention could be described as are two-dimensional current distributor, having electron ducts, interconnected at nodes, which nodes form junctions of at least one entrance and at least two exhaust ducts, whereby at each node, a through the entrance duct incoming electron current can, by means of apertures connecting the entrance and exhaust ducts, be steered in a desired exhaust duct. In the above shown examples, the electron currents move, apart from the feedthroughs between the transport ducts, in the transport ducts in the horizontal and/or vertical direction. The invention is not limited thereto. The network can be three-dimensional and comprise transport ducts in three or more directions. In the examples, the image displayed is two dimensional. The invention is not limited thereto, the image displayed can be three-dimensional, for example, it can be displayed on the sides of a cube. It is alternatively possible to display the image on the surface of a hemisphere, the network being constructed so as to form a number of hemispheres which are stacked on top of each other, and each hemisphere comprising transport ducts.

A second aspect of the invention is formed by a means for guiding electrons, said means comprising a two or three-dimensionally branched network of electron transport ducts having one or more entrances for injecting electrons into the network and one or more exits for extracting electrons from the network, said network comprising means for directing the electron current injected into an entrance through the branched network towards a desired exit. The exits and/or entrances may form a two or three-dimensional array and the nodes of the network may also form a two or three-dimensional array.

Such a means can be used in a display device in which, for example, electron currents are directed from an entrance of the network towards exits, as in the above-described examples. The means can however also be used, for example, in a pick-up device or photometer, in which case the means has a large number of entrances in front of which light-sensitive elements are arranged which emit electrons under the influence of light or, more generally, under the influence of electromagnetic radiation. Said electrons are selectively directed towards an exit via the network. By virtue thereof, the light distribution over a surface or, for example, over a convex surface can be measured. In that case, of course each node forms the junction between at least two entrance ducts and one exhaust duct.

Figure 10:
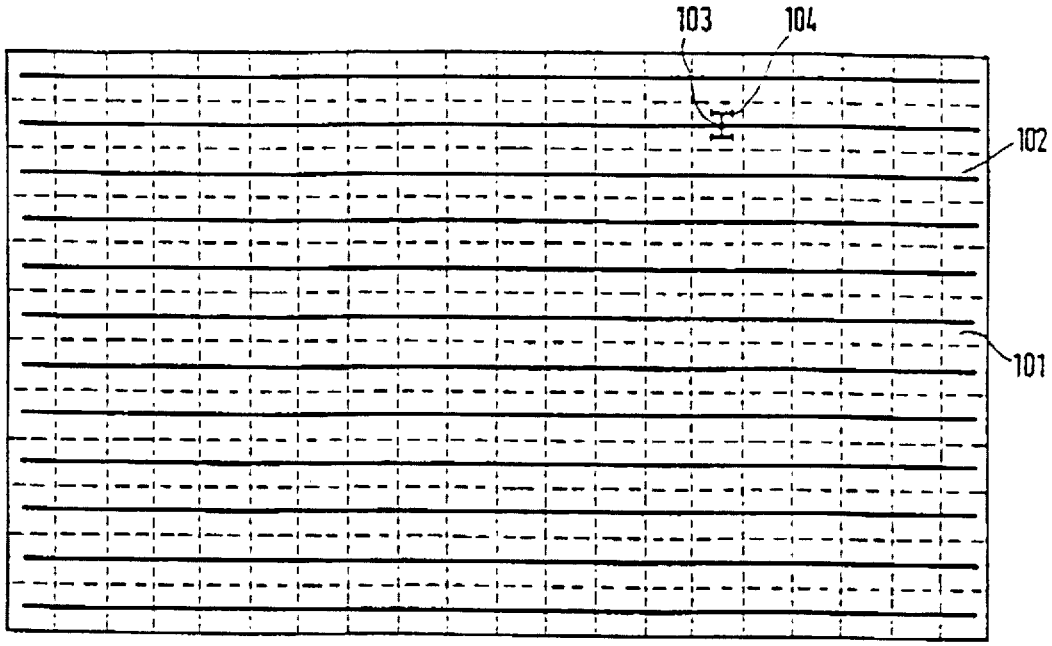
FIG. 10 shows in front view a further example of a device according to the invention.

FIG. 10 shows schematically a device having a number of current distributors (or tiles) 101 and a number of line cathodes 102. Each current distributor has an entrance aperture 103 and a system of electron ducts 104. The number of line cathodes is preferably larger or equal to 4 and smaller or equal to 32. The sum of two sources of energy loss, namely the energy needed to steer the electron currents through the current distributors and the energy needed to heat the line cathodes is then advantageous. Preferably the number of line cathodes is $2^n$ where preferably $2 \leqq n \leqq 5$.

Figure 11A:
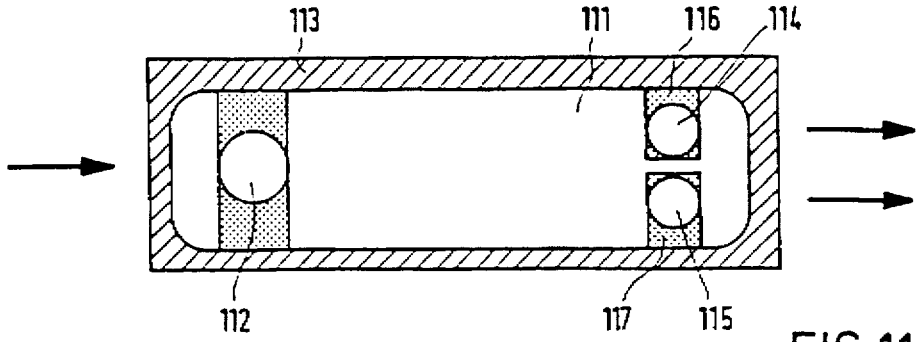
FIG. 11A to 11D show several embodiments of a building block for a device according to the invention.
Figure 11B:
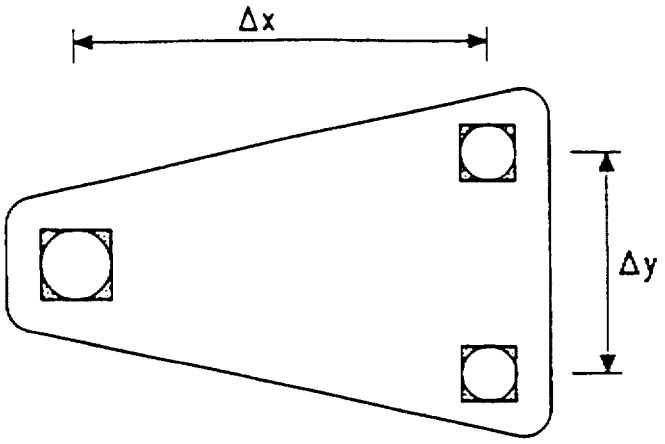
Figure 11C:
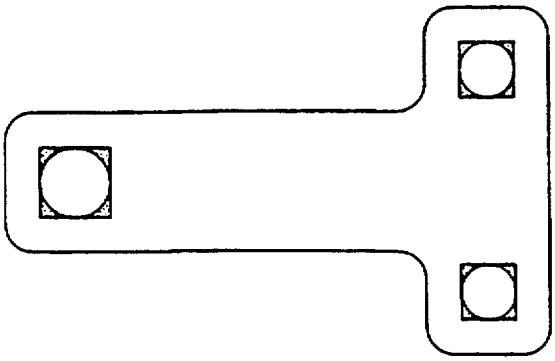
Figure 11D:
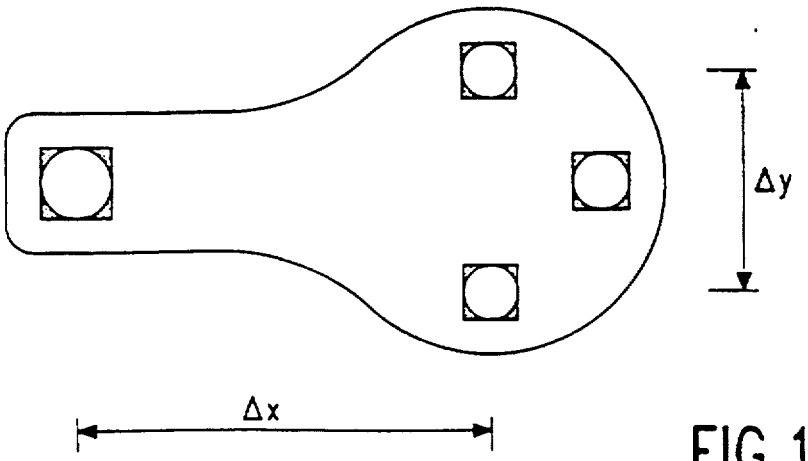

FIGS. 11A to D show a building block for embodiments of a device according to the invention. FIG. 11A shows a transport duct 111 having at one side a single entrance aperture 112 associated with said entrance aperture an entrance electrode 113, said transport duct having at the opposite side of the transport duct two exhaust apertures 114 and 115, with corresponding electrodes 116 respectively 117. By applying in operation a transport voltage between the entrance and exit apertures and applying a switch voltage between the exit apertures, it is possible to selectively steer the current to either one of exit apertures 114 or 115. Thus the building block as shown in FIGS. 11A to 11D function as a current switch. Such building blocks are also shown in FIG. 4. FIGS. 11B to 11D shows variations on the design as shown in FIG. 11A. Such transport ducts are preferably made in plates of isolating material with the longitudinal direction of the transport ducts being parallel to the plates, as shown in FIG. 4.

In the examples shown in FIGS. 11A to 11C there are two exhaust apertures, which is a preferred embodiment. There can be, however, more than two exhaust apertures, for instance three as shown in FIG. 11D. Since transport through the transport duct is always in the same direction (and thus the transport voltage over the transport duct is always in the same direction) switching between the two (or more) exhaust apertures can be accomplished very fast, compared to set-ups in which a longitudinal transport ducts has an entrance aperture in the middle of the transport duct and exhaust apertures at opposite sides of the transport ducts. Between the entrance aperture and the exit apertures there is applied in operation a transport voltage $V_t$ and a switching voltage $V_s$. The smaller the ratio between the two voltages the easier and faster the current can be switched between the two apertures. This ratio is, in a building block as shown in FIG. 11A, much smaller than for a design in which the entrance aperture is in the middle of transport duct. This holds especially if the distance between the entrance and exit holes becomes more than a few millimetres. Besides the effect that the switching of the currents becomes faster and simpler, it is also an advantage that the switching voltage itself, for a "current switch" as shown in FIGS. 11A to 11D is in general much less dependent on the length of the transport duct than for a "current switch" having an entrance in the middle of the transport duct. Preferably the distance between the entrance and exit apertures is substantially the same for each entrance to each exit. Preferable the distance between the entrance and exit holes (designated by $\Delta x$ in FIG. 11B and 11D) is larger than 0.5 times the distance between the exit apertures. (designated by $\Delta y$ in FIGS. 11B and 11D), and most preferably larger than 1.0 time ($\Delta x/\Delta y \leqq 1$). The distances are taken between the centres of the apertures. The invention therefore also relates to a display device comprising a vacuum envelope on an inner side of which there is provided an electroluminescent display screen, said vacuum envelope comprising at least an electron source and means for directing electrons towards the display screen, said means comprising electron ducts, characterized in that the means comprise at least one transport duct having an entrance aperture at one end of the transport duct and, at the opposite end two or more exhaust apertures.

Figure 12:
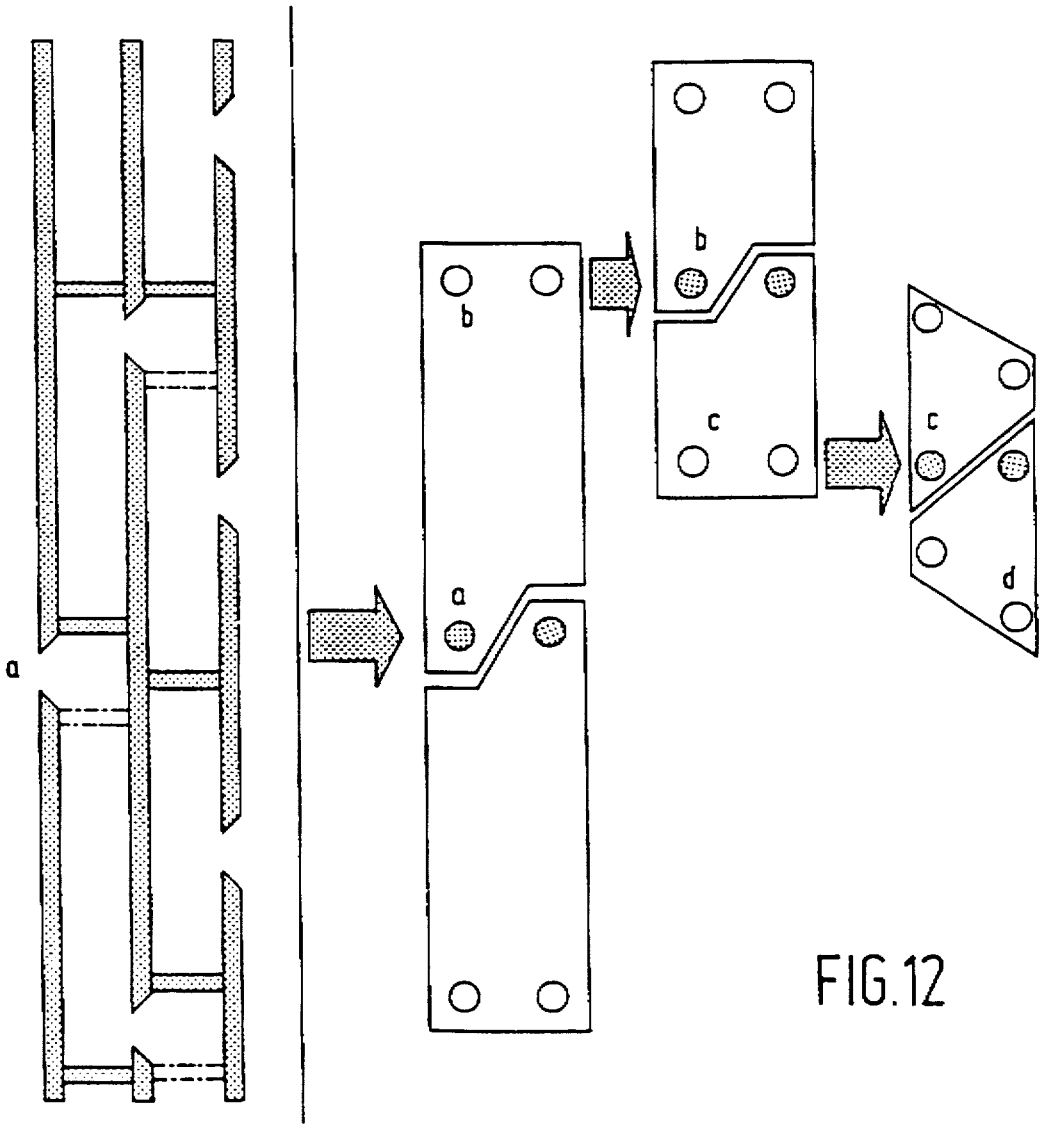
FIG. 12 shows a schematic front view of a device having several line cathodes and networks.

FIG. 12 shows in cross-section (bottom of the figure) and front view (upper part of the drawing) schematically a set-up in which starting from an entrance aperture a final apertures d are reached by means of a branched net-work, each step of the network comprising a number of transport ducts having at one end an entrance aperture (black dots) and at the other end exhaust apertures (circles) where an exhaust aperture of one transport duct corresponds to the entrance aperture of the following transport duct.

Figure 13:
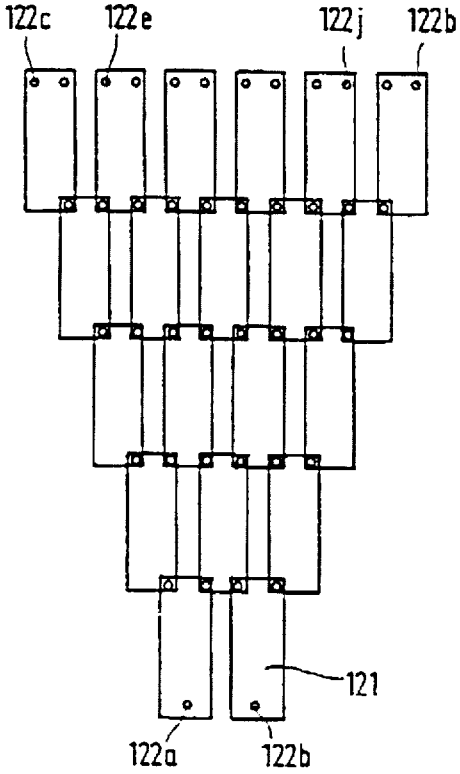
FIG. 13 shows schematically two overlapping networks.

In the embodiment shown in FIGS. 11 and 12 there is, for each transport duct a single entrance aperture. In embodiments where there are more than one, for instance two entrance apertures at the one end, it is possible to make a system of current switches, in which it is possible that viewed from an entrance there are two (or more) different paths to reach an exit. Schematically an example is shown in FIG. 13. In this figure there is shown a number of transport ducts 121, and apertures 122. For simplicity all ducts are drawn in one plane. The staring apertures are 122*a* and 122*b*, the exit apertures are designated 122*c* to 122*m*. Starting from the initial apertures 122*a*, the final exits 122*c* to 122*k* can be reached. Starting from initial aperture 122*b* the final exits 122*e* to 122*m* can be reached. Blockage of any of the apertures (except the final exit apertures) 122 can be at least partly and often completely circumvented. The number of rejects can thereby be reduced. Thus an example of a branched network in which it is possible to "go around" a node in the network is shown in FIG. 12.

FIG. 13 can also be interpreted as showing, starting from the entrance apertures 122*a* and 122*b*, two overlapping branched networks, the first network beginning with entrance aperture 112*a* and having exit apertures 122*c* to 122*l*, the second branched network beginning with entrance aperture 122*b* and having exit apertures 122*e* to 122*m*. It will be clear that this basic scheme (two partially overlapping networks, each having one starting duct and sharing common transport ducts ending in at least partially common end ducts) can be implemented in very differing ways. For instance more than two overlapping networks can be used, (in FIGS. 13 this would mean adding an extra entrance duct next to either of the begin ducts). The degree of overlapping can also be changed, for instance in FIGS. 11A to 11D the begin ducts (=the ducts having the entrance apertures 122*a* and 122*b*) can each be shifted one step sidewards (sidewards being in FIG. 13 in the horizontal direction). It is then possible to increase the networks sidewards. The result is that the overlap decreases, whereas the total number of exit apertures increases. By placing several overlapping networks next to each other, wherein each right half of a network overlaps the lefthalf of the adjacent network, it is possible to build a display device, in which, apart from the outer most fringes of the display, malfunctioning of any of the sources can be overcome. In FIG. 13 a line of exit apertures is shown, it will be clear that the same basic scheme can also be used for partially overlapping networks which networks end in a two or three dimensional (for instance rectangular, square or honey-comb like) array of exit apertures. The number of rejects can thereby be reduced.

What is claimed is:

1. A display device comprising; a vacuum envelope having on an inner side thereof an electroluminescent display screen, said vacuum envelope comprising at least an electron source and means for directing electrons towards the display screen, said electron directing means comprising a branched network of electron-transport ducts having at least a wall, one entrance for electrons and two exits at the end portions of the network, so that in operation, interaction between electrons and the wall of the electron-transport ducts cause an electron current flow in the electron-transport ducts when an electron current is supplied to an electron-transport duct via said at least one entrance, said network having means for directing the electron current entering via the entrance through the branched network, via nodes of the network, towards a desired exit, and wherein the exits of the network corresponding to one entrance form a two or three dimensional array of exits.

2. The display device as claimed in claim 1, wherein the network is two- or three dimensional branched whereby the exits form a two- or three dimensional array.

3. The display device as claimed in claim 1 wherein each node of the network comprises one supply duct and two or more exhaust ducts, the supply duct having two or more exhaust apertures, one for each exhaust duct.

4. The display device as claimed in claim 1, wherein the distance, via the network, between an entrance and each exit which can be reached from said entrance, is substantially equal.

5. The display device as claimed in claim 1, wherein the number of nodes situated between an entrance and an exit is the same for each entrance and exit.

6. The display device as claimed in claim 5, wherein the number of nodes in the network between an entrance and an exit of the network does not exceed 12.

7. The display device as claimed in claim 5, wherein the number of nodes in the network between an entrance and an exit is greater than 4.

8. The display device as claimed in claim 1, wherein there is an odd number of nodes between an entrance and an exit.

9. The display device as claimed in claim 1, wherein the display device includes a number of modules, each of said modules comprising a branched network of electron-transport ducts.

10. The display device as claimed in claim 9 further comprising a number of line cathodes for supplying the electron current, said number being larger or equal to 4 and smaller or equal to 32.

11. The display device as claimed in claim 10, wherein the number of line cathodes is $12^n$ where $2 \leqq n \leqq 5$.

12. The display device as claimed in claim 1, wherein the network has $n^m$ exits, n and m being integers greater than 1.

13. The display device as claimed in claim 12, wherein n is two.

14. A display device comprising; a vacuum envelope having on an inner side thereof an electroluminescent display screen, said vacuum envelope comprising at least an electron source and means for directing electrons towards the display screen, said electron directing means comprising at least one transport duct having an entrance aperture at one end of the transport duct and, at the opposite end, two or more exhaust apertures, wherein the distance between each of the exhaust apertures and the entrance aperture is substantially equal.

15. The display device as claimed in claim 4, wherein the at least one transport duct comprises at said one end two or more entrance apertures.

16. The display device as claimed in claim 14 which comprises a branched network of transport ducts including said at least one transport duct, wherein the network includes at least one node for directing electrons in at least two different directions ending in at least first and second exits which form at least a two dimensional array of exits corresponding to one entrance for the electron source.

17. The display device as claimed in claim 16 wherein the distance, via the network, between an entrance and each exit which can be reached from said entrance, via the network, is substantially equal and the number of nodes situated between an entrance and an exit is the same for each entrance and exit.

18. The display device as claimed in claim 17 wherein each node of the network comprises one supply duct and two or more exhaust ducts, the supply duct having two or more exhaust apertures, one for each exhaust duct.

19. A display device comprising; a vacuum envelope having on an inner side thereof an electroluminescent display screen, said display device comprising means for selectively directing electron currents from at least one source to the display screen, said electron directing means comprising two or more partially overlapping networks of transport ducts, each having an entrance, a begin duct and sharing common transport ducts ending in at least partially shared end ducts having exits, the exits of each network forming a two or three dimensional array of exits.

20. A means for directing electrons from an entrance to exits, said electron directing means comprising a branched network of electron-transport ducts having one or more entrances for injecting electrons into the network and one or more exits for extracting electrons from the network, said network comprising means for directing the electron current entering via an entrance through the branched network, via nodes, towards a desired exit, wherein the network is two- or three dimensional branched whereby the exits form a two- or three dimensional array.

21. A means for directing electrons from an entrance to exits, comprising between the entrance and the exits at least one transport duct having at least a wall, so that in operation, interaction between electrons and the wall of the electron-transport ducts cause an electron current flow in the electron-transport ducts when an electron current is supplied to an electron-transport duct via said at least one entrance, and including at one end of the transport duct an entrance aperture and at the opposite end of the transport duct two or more exhaust apertures to selectively direct an electron current from the one entrance aperture to a selected one of the exhaust apertures, wherein the distance between each of the exhaust apertures and the entrance aperture is substantially the same.

22. The means for directing electrons as claimed in claim 21, wherein at the one end, the transport duct comprises more than one entrance aperture.

* * * * *